US006074258A

United States Patent [19]

Arai et al.

[11] Patent Number: 6,074,258

[45] Date of Patent: Jun. 13, 2000

[54] COVER ARRANGEMENT FOR OUTBOARD MOTOR

[75] Inventors: Hideto Arai; Kazumasa Tanimoto, both of Hamamatsu, Japan

[73] Assignee: Sanshin Kogyo Kabushiki Kaisha, Japan

[21] Appl. No.: 09/054,123

[22] Filed: Apr. 2, 1998

[30] Foreign Application Priority Data

Apr. 2, 1997 [JP] Japan ..... 9-083767

[51] Int. Cl.[7] ..... B63H 20/32

[52] U.S. Cl. ..... 440/77; 440/89

[58] Field of Search ..... 440/77, 88, 89, 440/900; 123/195 P

[56] References Cited

U.S. PATENT DOCUMENTS 4,800,854 1/1989 Boda et al. ..... 440/77

5,487,687 1/1996 Idzikowski et al. ..... 440/77

*Primary Examiner*—Jesus D. Sotelo

*Attorney, Agent, or Firm*—Knobbe, Martens, Olson & Bear, LLP

[57] ABSTRACT

An outboard motor outer cover arrangement The outboard motor is comprised primarily of a powerhead and a drive shaft housing and lower unit which depends from the powerhead. The powerhead is comprised of an internal combustion engine and a surrounding protective cowling. The protective cowling comprises a lower tray portion and a detachable main cowling portion that is detachably connected to the tray portion. An exhaust guide is provided at the upper end of the drive shaft housing and lower unit and the engine is supported on this guide plate as is the tray. A cover is detachably connected to the underside of the exhaust guide and is positioned in partially surrounding relationship to the upper portion of the drive shaft housing and lower unit so as to provide a neat appearance.

9 Claims, 6 Drawing Sheets

COVER ARRANGEMENT FOR OUTBOARD MOTOR

BACKGROUND OF THE INVENTION

This invention relates to an outboard motor and more particularly to an improved cover arrangement for an outboard motor.

As is well known, most outboard motors are comprised of a powerhead that contains a powering internal combustion engine and which is surrounded by a protective cowling. The protective cowling generally comprises a lower tray portion and an upper main cowling portion that is detachably connected to the tray portion in order to facilitate access to the engine for servicing.

As is conventional, the engine of the powerhead normally has its crankshaft rotating about a vertically extending axis. This is to facilitate connection to a drive shaft that is journaled in a drive shaft housing and lower unit that depends from the powerhead. This drive shaft continues on to drive a propulsion device for propelling the associated watercraft. The propulsion device is contained within the lower unit portion of the drive shaft housing and lower unit and may be of any known type. For example, the propulsion device may be a propeller or a jet pump.

In connection with the outer housings of the various components, there are several different pieces and these pieces are connected to each other and frequently are formed from different materials. For example, the tray and outer housing of the drive shaft housing and lower unit are formed from aluminum quite commonly. The main cowling portion is formed generally from a molded fiberglass reinforced resin or the like.

In connection with the internal construction, the engine is generally mounted on an exhaust guide that spans the upper part of the drive shaft housing and through which the exhaust gases are transferred to an exhaust system in the lower unit.

In accordance with the practice, the area between the tray and the drive shaft housing may have, in some instances, a substantial gap. It has been the practice to provide a further cover that is attached in some manner, normally to the tray, and which encloses this area to provide a neater appearance. However, there are times when it is necessary or desirable to remove this added cover in order to facilitate certain servicing or other operations. This is rather difficult when the components are mounted as in the prior practice.

It is, therefore, a principal object of this invention to provide an improved cover and cover attachment mechanism for an outboard motor.

It is a still further object of the invention to provide a cover for an outboard motor that provides a neat appearance in the area between the tray and drive shaft housing of the outboard motor and which can be conveniently attached and detached for certain types of servicing operations.

SUMMARY OF THE INVENTION

This invention is adapted to the embodied in an outboard motor that is comprised primarily of a powerhead and a drive shaft housing and lower unit which depends from the powerhead. The powerhead is comprised of an internal combustion engine and a surrounding protective cowling. The protective cowling comprises a lower tray portion and a detachable main cowling portion that is detachably connected to the tray portion. An exhaust guide is provided at the upper end of the drive shaft housing and lower unit and the engine is supported on this guide plate. The exhaust gases from the engine are discharged downwardly through the exhaust guide to an exhaust system in the drive shaft housing and lower unit for eventual discharge to the atmosphere. A cover is detachably connected to the exhaust guide and is positioned in partially surrounding relationship to the upper portion of the drive shaft housing and lower unit so as to provide a neat appearance.

DETAILED DESCRIPTION OF THE PREFERRED EMBODIMENT

Figure 1:
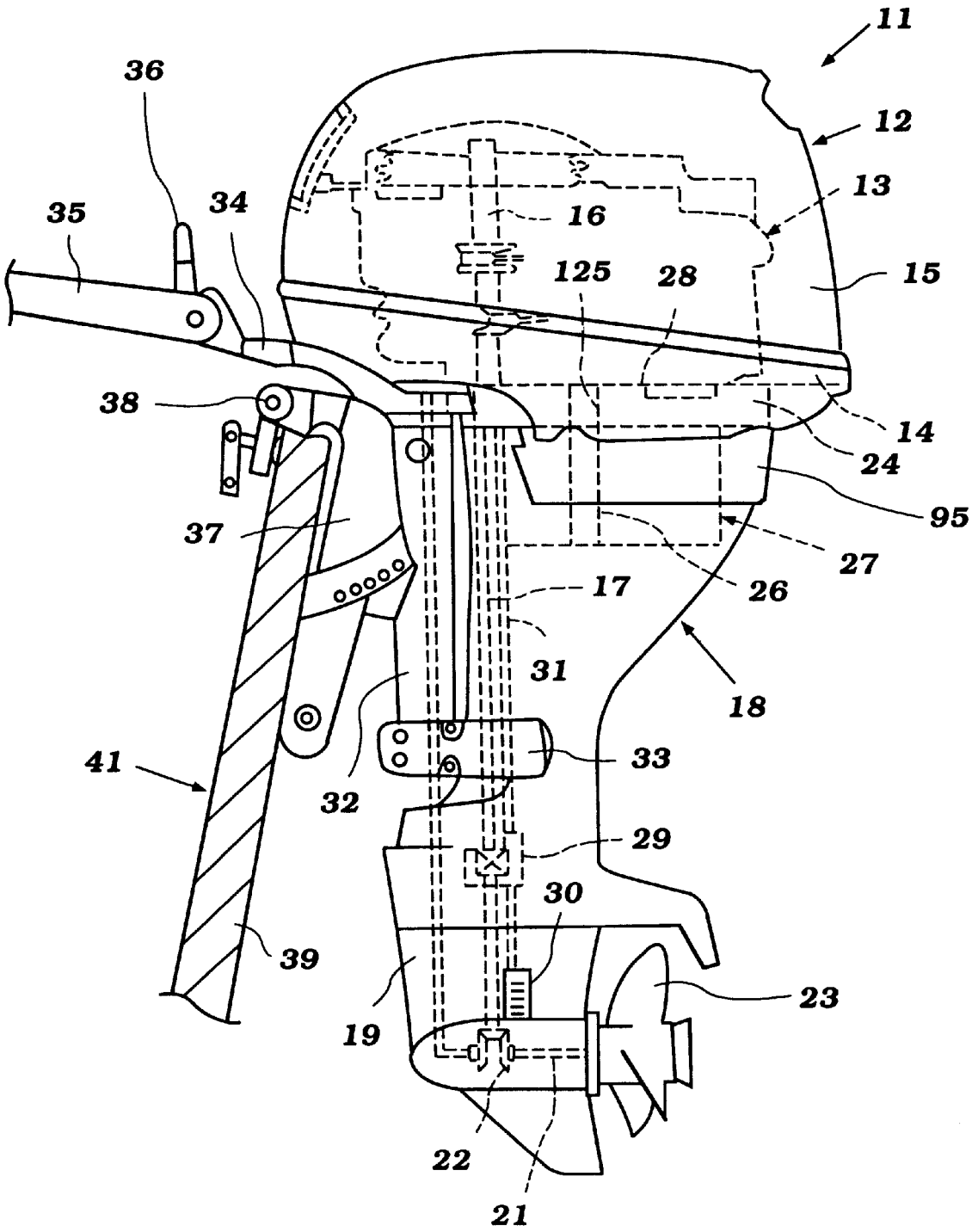
FIG. 1 is a side-elevational view of an outboard motor constructed in accordance with a preferred embodiment of the invention and shown attached to the transom of a watercraft which is shown only partially and in cross-section.

An outboard motor constructed in accordance with the preferred embodiment is shown in more detail in FIGS. 1–6. The outboard motor, indicated generally by the reference numeral 11, will be described first by primary reference to FIG. 1. The outboard motor 11 is comprised of a power head, indicated generally by the reference numeral 12. This includes an internal combustion engine, which is shown in phantom and which is identified generally by the reference numeral 13.

In the specific embodiment illustrated, the engine 13 is a two cylinder, inline type four cycle engine. Although the invention is described in conjunction with such an engine, it should be readily apparent that the invention can be utilized with engines having other cylinder numbers and other configurations. The invention does, however, have particular utility with four cycle engines because of their need for a separate lubricating system and lubricant reservoir within the outboard motor.

The power head 12 is completed by a protective cowling which encircles the engine 13. This protective cowling is comprised of a lower tray 14 preferably formed from a lightweight, high-strength material such as aluminum or aluminum alloy. In addition, a main removable cowling member 15 is detachably connected to the tray 14 and encloses in substantial part the engine 13. The main cowling member 15 is formed preferably from a lightweight high-strength material. A molded fiberglass reinforced resin or the like is normally utilized for this purpose. The way in which the tray 14 is connected to the remainder of the components will be described later, primarily by reference to FIGS. 5 and 6.

As is typical with outboard motor practice, the engine 13 is supported within the power head 12 so that its crankshaft 16 rotate about a generally vertically disposed axis. This is to facilitate a driving connection to a drive shaft 17 that is rotatably journaled in a suitable manner within a drive shaft housing and lower unit, indicated generally by the reference numeral 18. This drive shaft 17 depends downwardly into a lower unit portion 19 of the drive shaft housing and lower unit assembly 18.

The drive shaft 17 there drives a propeller shaft 21 through a conventional bevel gear reversing transmission 22. A propulsion device such as a propeller 23 is fixed for rotation with the propeller shaft 21 for propelling an associated watercraft, to be described shortly, to which the outboard motor 11 is affixed in a manner which will also be described, through the body of water in which the watercraft is operating.

An exhaust guide 24 extends across and is affixed to the upper end of the drive shaft housing 18 in a known manner. The engine 13 is supported on this exhaust guide 24. The engine 13 has a suitable internal exhaust manifold that has a discharge end which mates with an exhaust passage 25 (FIGS. 1 and 2) of the exhaust guide 24. An exhaust pipe 26 is affixed, in a manner to be described, to the lower end of the exhaust guide 24 and collects the exhaust gases. These exhaust gases are then discharged, in a manner which will be described, through an internal cavity formed in an oil pan, indicated generally by the reference numeral 27 and which has a construction as will be described.

The oil pan 27 contains lubricant for the engine 13. This lubricant is circulated by means of an oil pump 28 which is driven from the engine 13 in a suitable manner. For example, the oil pump 28 may be driven off the end of a cam shaft (not shown) of an overhead cam shaft mechanism for the engine 13.

Continuing to refer primarily to FIG. 1, the engine 13 is also water-cooled. Coolant is circulated through the cooling jacket of the engine 13 by means of a water pump 29. The water pump 29 is mounted at the lower portion of the drive shaft housing 18 above the lower unit 19 and is driven by the drive shaft 17. A water inlet opening 30 in the lower unit 19 delivers water to the inlet side of the water pump 29.

This water is then pumped upwardly for circulation through the engine cooling jacket through a water delivery pipe 31, which will also be described in more detail later.

A steering shaft (not shown) is rotatably journaled within a swivel bracket 32. This steering shaft is connected to the drive shaft housing and lower unit assembly 18 by a lower mounting bracket 33 and an upper mounting assembly. These mounting brackets support the steering shaft for steering movement of the outboard motor 11 about a vertically extending steering axis defined by the swivel bracket 32. The steering shaft has affixed to its upper end a tiller 34 to which a pivoted tiller control 35 is mounted for control of the outboard motor's steering position. In addition a shift control 36 is mounted to the rear of the tiller control 35 for controlling the transmission 22 in a known manner.

The swivel bracket 32 is, in turn, affixed for pivotal movement to a clamping bracket 37 by a pivot pin 38. Pivotal movement of the swivel bracket 32 and, accordingly, the outboard motor 11 about the pivot pin 38 achieves tilt and trim movement of the outboard motor 11, as is well known in this art.

The clamping bracket 37 is detachably connected by a suitable mechanism to a transom 39 of a watercraft 41. Hence, the outboard motor 11 will propel the watercraft 41 in a well-known manner through the body of water in which the watercraft operates.

Figure 2:
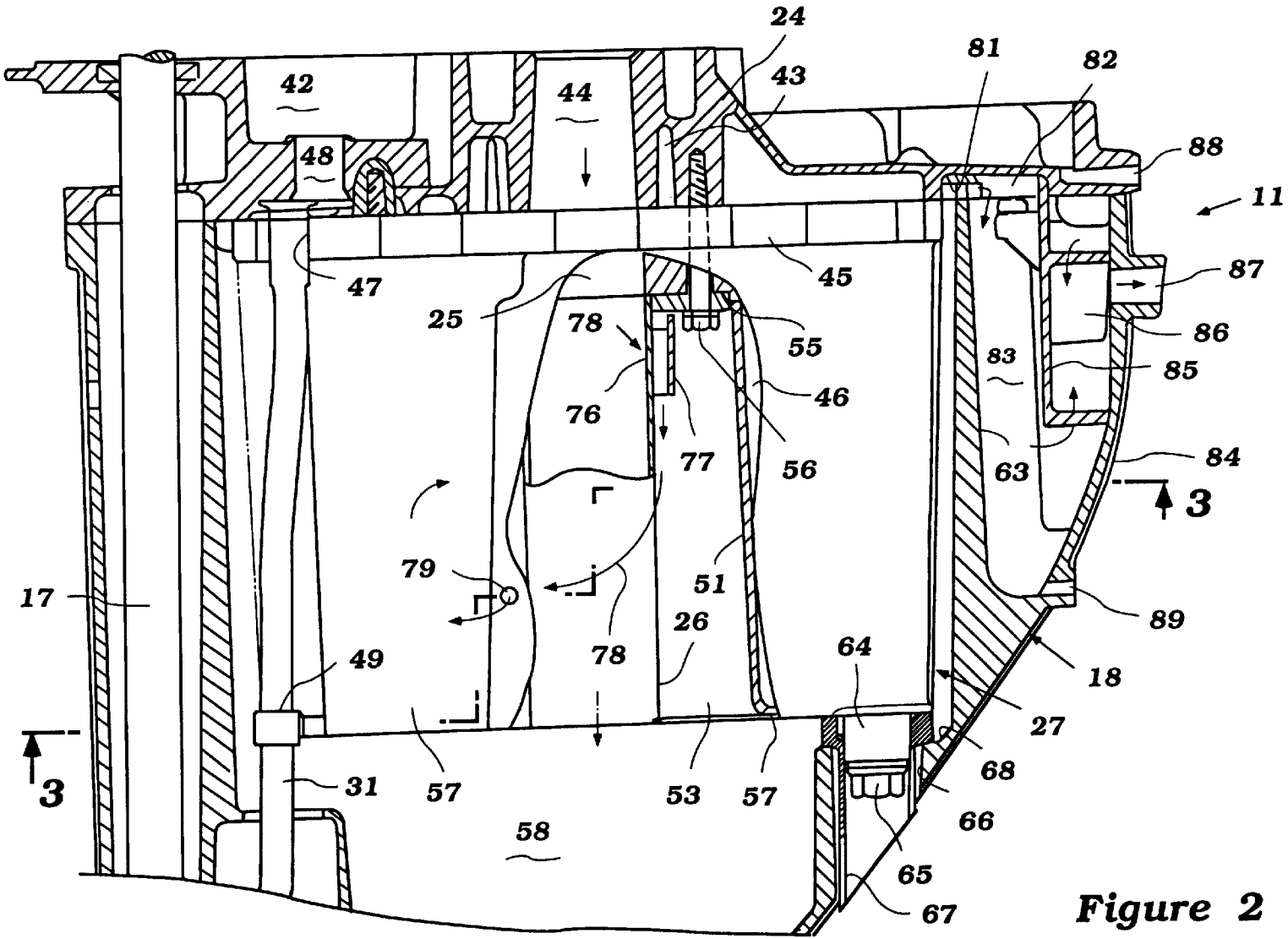
FIG. 2 is a partial cross-sectional view taken through the rear upper portion of the exhaust guide and adjacent drive shaft housing and lower unit with the powerhead removed.
Figure 3:
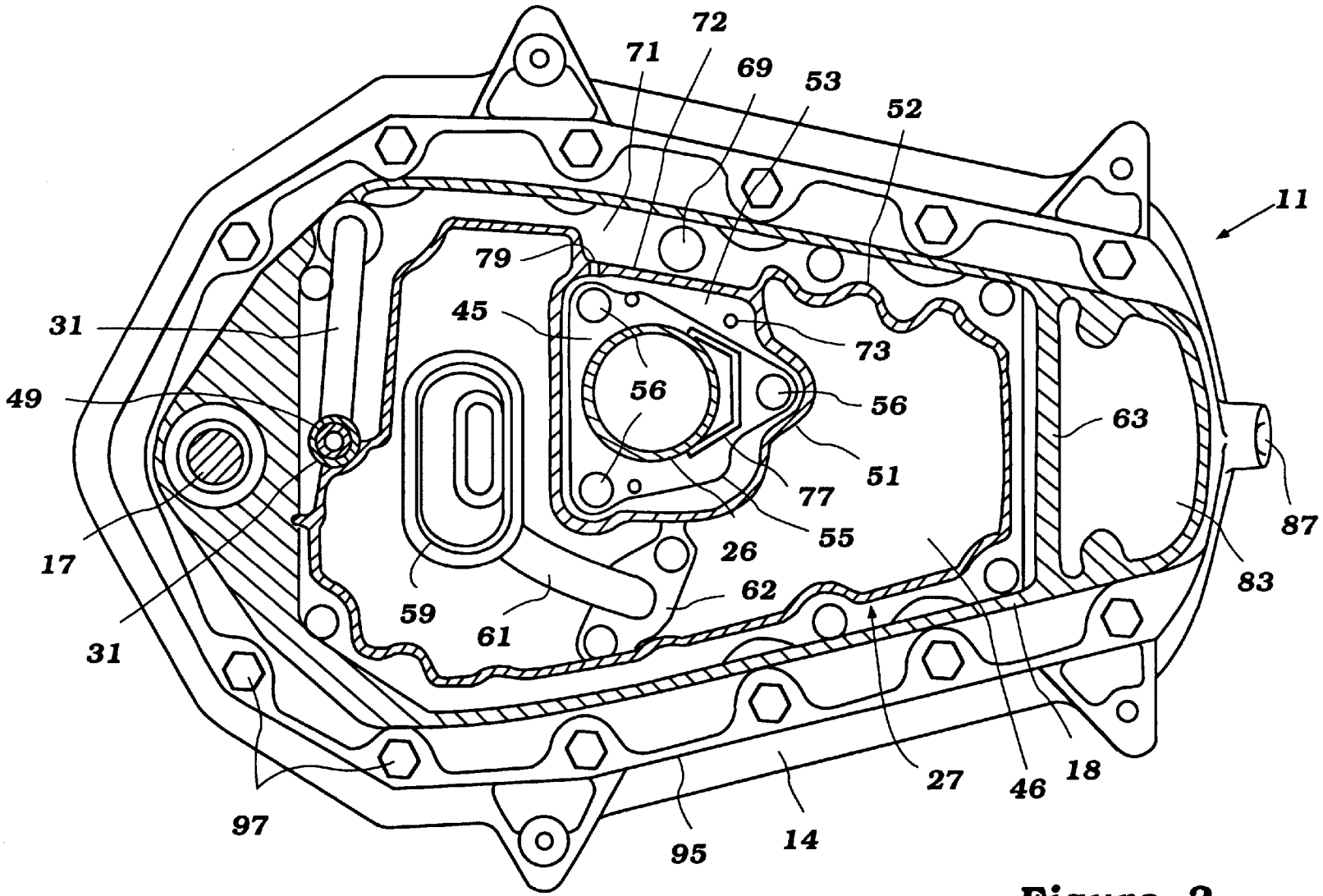
FIG. 3 is a partial cross-sectional view taken through the upper portion of the drive shaft housing and lower unit and is taken generally along the line 3—3 of FIG. 2.
Figure 4:
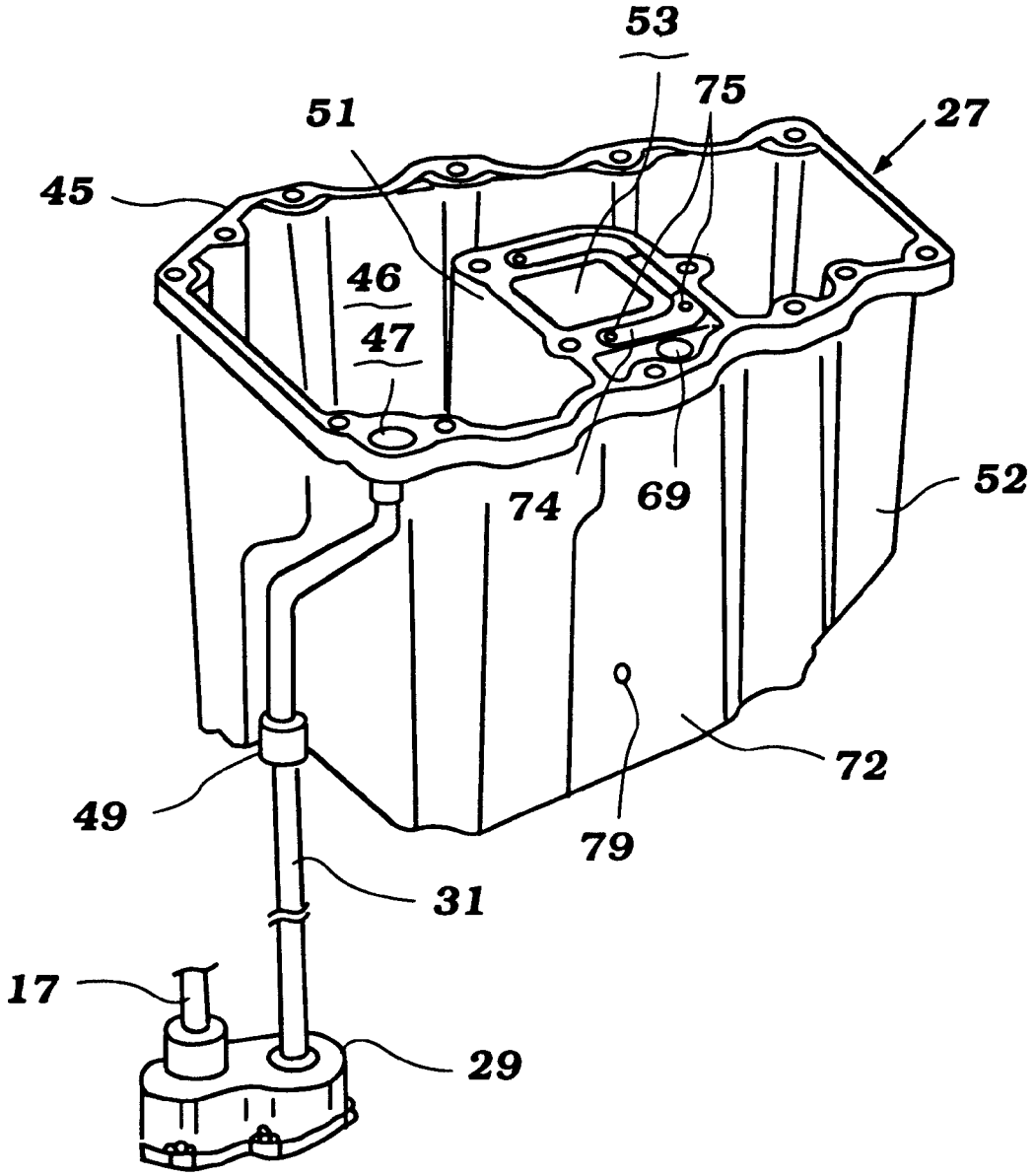
FIG. 4 is a perspective view showing the water pump and the oil pan of this embodiment.

Referring now primarily to FIGS. 2–4, it will be seen that the exhaust guide 24 is provided with a recessed cavity 42 that receives coolant from the conduit 31. This coolant is then delivered in a suitable manner to the cooling jacket of the engine 13. Returned water is delivered, at least in substantial part, to a water jacket 43 that surrounds an exhaust passage 44 in the exhaust guide 24. This water is returned to the body of water in which the watercraft 41 is operating in a manner which will be described later.

Referring first to the construction of the oil pan 27, this construction is shown in perspective view in FIG. 4. The oil pan 27 has an upper peripheral flange 45 that has a number of openings so as to provide a means by which it is attached to the underside of the exhaust guide 24. As may be also seen in the figures, the oil pan 27 is defined by upstanding outer peripheral walls that define an oil receiving chamber 46.

At one comer of the flange 45, there is provided an opening 47 to which the upper end of the conduit 31 delivers its coolant. This passage 47 communicates with the exhaust guide water chamber 42 through a short passage 48. At the lower end of this outer peripheral wall, a connector 49 or hose retainer is provided that holds the intermediate end of the conduit 31 against vibration.

The oil chamber 46 is defined on its inner peripheral edge by a further upstanding wall 51 which is integrally formed with the oil pan 27 and is spaced inwardly from an outer peripheral wall 52, except for a portion, as will be noted later. This defines a generally vertically extending passage or chamber 53 through which an exhaust pipe 26 extends.

As best seen in FIG. 2, the exhaust pipe 26 is formed at its upper end with an outer peripheral flange 55 which is fixed to the exhaust guide 24 by elongated threaded fasteners 56. This configuration leaves an air gap between the outer peripheral edge of the exhaust pipe 26 and the inner surface of the wall 51 so as to provide for some heat insulation between the exhaust pipe 26 and the oil pan 27.

In addition, this space may act as an expansion chamber, in a manner which will be described, so as to provide silencing for the exhaust gases. It should be noted that the lower end of the exhaust pipe 26 in this embodiment terminates at a point which is not substantially below a lower wall 57 of the oil pan 27. More conventional structures extend the exhaust pipe much below this area and, therefore, there is a likelihood that water might be able to enter into the exhaust system.

The exhaust pipe 26 terminates at its lower end with an expansion chamber 58 that is formed in the drive shaft housing 18 and thus the exhaust gases can be silenced by expansion in this expansion chamber and then discharged to the atmosphere through a suitable underwater exhaust gas discharge system, which can utilize a through the hub exhaust.

It has been noted that the lubricant is drawn from the oil pan by the oil pump 28. A strainer 59 depends into a lower surface of the oil pan 27 and is connected by means of a conduit 61 to a flange 62 that is mounted to the underside of the exhaust guide 24. This communicates directly with the inlet side of the oil pump 28 in any suitable manner.

It should be noted that the rearward end of the oil pan 27 extends rearwardly adjacent an upstanding integral wall 63 of the drive shaft housing 18. The lower portion of the oil pan 27 is formed with a drain nipple 64 which has an axial extent that is parallel to the axis of rotation of the drive shaft 17 and thus is vertical.

A drain plug 65 is threadingly engaged in this drain nipple 64 and is accessible through a vertically extending opening 66 formed in the rearward portion of the drive shaft housing 18 just forward and adjacent the wall 63. A combined seal and protective tube 67 is interposed between the upper end of a ledge 68 formed forwardly of the wall 63 and the lower surface 57 of the oil pan 27. This provides not only a seal but will also dampen vibrations and protect the components.

The way in which water is returned from the engine cooling jacket back to the body of water in which the water craft is operating will now be described in detail by continued reference primarily through FIGS. 2–4.

First, there is provided a main water drain passage 69 (FIGS. 3 and 4) that extends through the exhaust guide 24 and in the upper portion of the oil pan 27 which communicates with an outer peripheral volume 71 that extends between the outer peripheral wall 52 of the oil pan 27 and the inner peripheral wall of the drive shaft housing 18. This is on the outer surface of the oil pan 27 and thus provides further insulation and protection of the oil pan 27 from heat.

Also, the cooling water will flow across a portion 72 of the outer wall 52 which portion is not wetted on its internal surface by the oil in the reservoir volume 46. In other words, the oil reservoir volume 46 does not completely circle the inner wall 51 of the oil pan 27. This is the common portion with the inner wall as previously noted. Thus, the wall portion 72 is not wetted directly by the oil and this unwetted portion is in the vicinity of the water return 69.

A smaller water return path in the area of the inner wall 51 and around the periphery of the exhaust pipe 54 is provided by a weep passage 73. This passage 73 is covered on its upper portion by a shroud or seal 74 held in place by a pair of small threaded fasteners 75.

An above the water low speed idle exhaust gas discharge path will now be described also by reference to FIGS. 2–4. This is comprised of an idle exhaust gas discharge opening 76 that is formed in the upper portion of the exhaust pipe 26 adjacent the flange 55. This small opening is shielded by a baffle 77 which is affixed by welding to the outer peripheral edge of the exhaust pipe 26. The baffle 77 is interposed between the opening 71 and the weep passage 73 so as to ensure that water cannot enter the exhaust pipe in this area through the idle exhaust gas discharge 76.

Thus, when there is a high enough back pressure in the underwater exhaust gas discharge, exhaust gases may flow in the direction indicated by the arrows 78 through the exhaust pipe opening 76 and downwardly under the direction of the baffle 77 into the area 53. Thus, there is a contraction and expansion of these exhaust gases that will be provide a good silencing effect.

These exhaust gases then flow downwardly to a small opening 79 formed in the oil pan wall portion 72. Hence, this unwetted portion of the oil pan wall 72 affords an exhaust gas discharge which can be formed above the lower end of the exhaust pipe 54 and through which the exhaust gases for the above the water discharge can pass.

These exhaust gases then can flow upwardly through the cavity 71 between the drive shaft housing 18 and the outer wall 52 of the oil pan 27. Thus these gasses need not pass below the oil pan 27, as with prior art constructions. This permits the drain nipple 64 to be located as it is.

As may be seen best in FIG. 2, these exhaust gases can then flow through a restricted opening 81 formed in the upper portion of the wall 63 and defined between the shield 74 across a passage 82 that communicates with an expansion chamber 83 formed by the wall 63 of the drive shaft housing and an outer surface 84 thereof.

These exhaust gases can then flow through a baffle wall 85 into a further expansion chamber 86. This expansion chamber 86 communicates with and above the water idle exhaust gas discharge port 87 that is formed in the rear portion of the drive shaft housing wall 84. Thus, the idle exhaust gases have several expansions and contractions and are very effectively silenced without significant restriction. In addition, the arrangement is such that water is not likely to enter the exhaust pipe 26.

Some of the engine coolant may be discharged through a tell tale opening formed in the exhaust guide 24. Such an opening is identified at 88 in FIG. 2. This gives the operator a visual indication that the engine 13 is receiving coolant.

Some water may separate from the exhaust gases in the idle exhaust gas discharge. This separation occurs primarily in the expansion chamber 83 due to the expansion that takes place therein. A drain passage 89 may be formed in the lower end of the chamber 83 so as to permit this separated water to drain.

Figure 5:
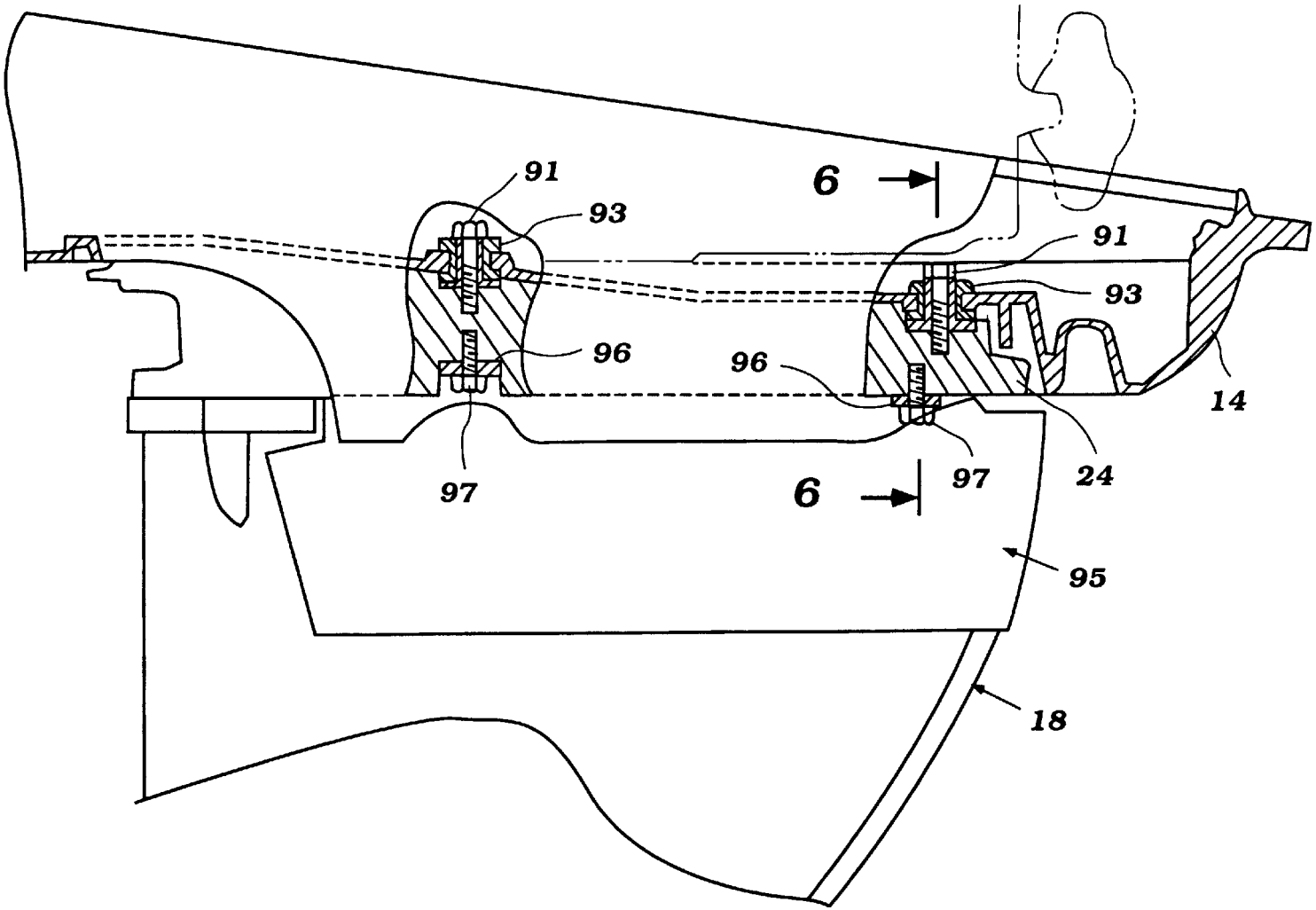
FIG. 5 is an enlarged side elevational view showing the area containing the tray of the powerhead and the upper portion of the drive shaft housing and lower unit illustrating the cover construction and with portions broken away so as to more clearly show the connection between the various elements.
Figure 6:
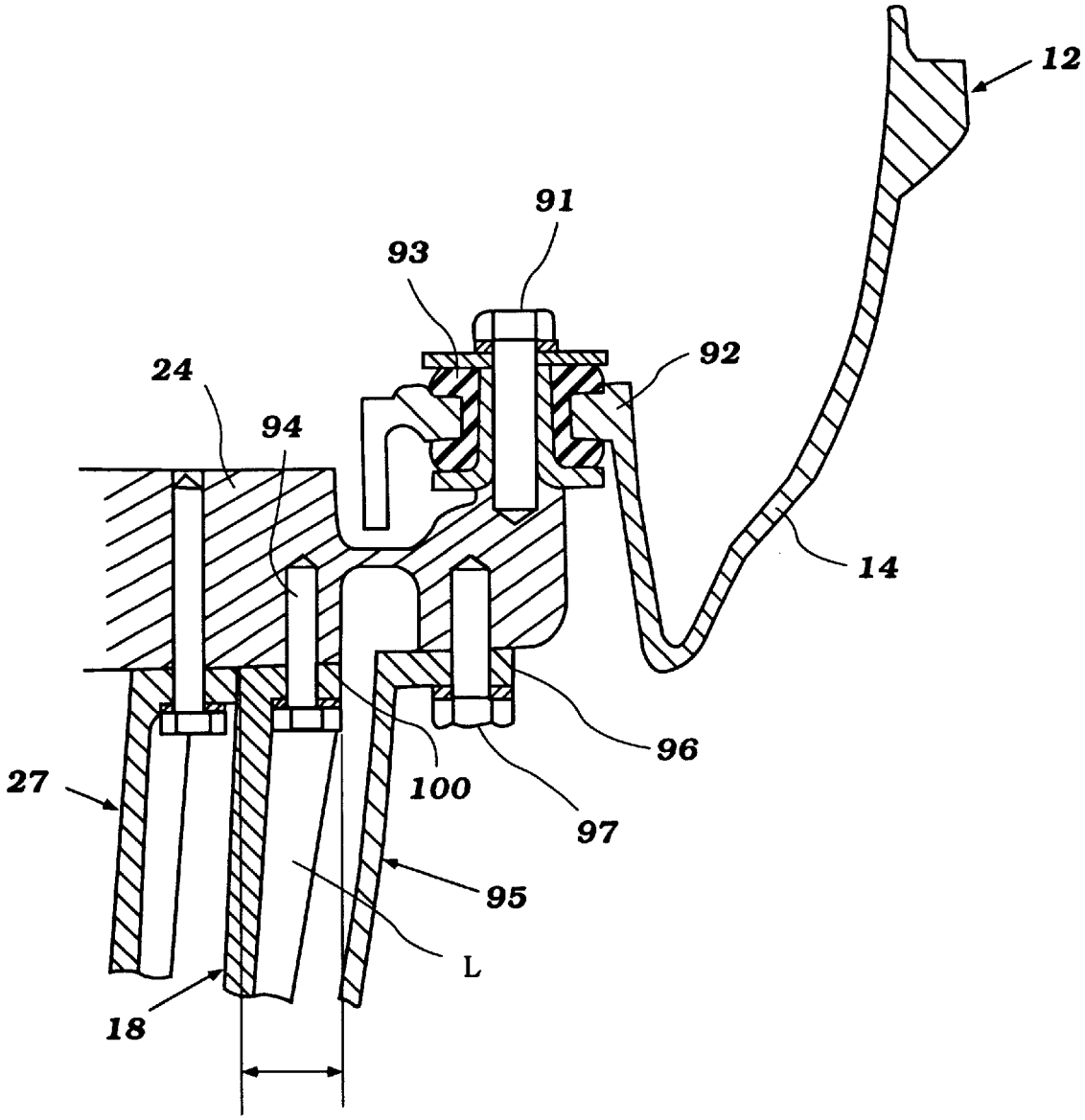
FIG. 6 is an enlarged cross-sectional view taken along the line 6—6 of FIG. 5.

The manner of attaching the various components to each other will now be described by primary reference to FIGS. 5 and 6. It has been noted that the lower tray 14 is attached to certain of the remaining assemblies. This connection is made to the exhaust guide 24.

This attachment is made by a plurality of threaded fasteners 91 which extend through flange portions 92 of the tray 14. Resilient grommets 93 are interposed between the tray portion 92 and the threaded fasteners 91 so as to absorb vibrations. The threaded fasteners 91 are threaded into tapped holes formed in an upper surface of the outer periphery of the exhaust guide 24 so as to complete this attachment.

The exhaust guide 24 is also connected to the upper end of the drive shaft housing 18. Threaded fasteners 94 extend through a flange 100 at the upper end of the drive shaft housing 18 and provide this connection.

As may be readily apparent, this leaves the connection 94 relatively open and this can be unsightly. Also, as best seen in FIGS. 5 and 6 there is a rather substantial gap between the tray 14 and the upper portion of the drive shaft housing 18. This gap is in part enclosed by means of a cover plate, indicated generally by the reference numeral 95 which extends around the middle portion of the drive shaft housing as best seen in FIGS. 1 and 5 and then rearwardly to wrap around the rear portion of the drive shaft housing 18.

A flange 96 of the cover 95 has openings that pass threaded fasteners 97 so as to fix the cover 95 to the underside of the exhaust guide 24. As may be best seen in FIG. 6, this construction provides a neat appearance and is generally shielded by the lower extremity of the tray 14.

As may also be seen in FIG. 6, there is a gap L that permits access to the fasteners 94 from below without removing the cover 95. Thus the power head 12 can be removed as a unit from the remainder of the outboard motor 11.

Of course, the foregoing description is that of a preferred embodiment of the invention and various changes and modifications may be made without departing from the spirit and scope of the invention, as defined by the appended claims.

What is claimed is:

1. An outboard motor comprised primarily of a powerhead and a drive shaft housing and lower unit which depends from said powerhead, said powerhead being comprised of an internal combustion engine and a surrounding protective cowling, said protective cowling comprising a lower tray portion and a detachable main cowling portion detachably connected to said lower tray portion, an exhaust guide plate provided at the upper end of said drive shaft housing and lower unit, said engine being supported on said exhaust guide plate, a passage for discharging exhaust gases, said passage communicating with said engine and extending downwardly through said exhaust guide plate to an exhaust system in said drive shaft housing, and a cover directly connected and secured to said exhaust guide plate positioned in partially surrounding relationship to an upper portion of said drive shaft housing and lower tray portion so as to provide a neat appearance.

2. An outboard motor as set forth in claim 1, wherein the cover is directly secured to the underside of the exhaust guide plate by threaded fasteners.

3. An outboard motor as set forth in claim 2, wherein the drive shaft housing and lower unit is also affixed to the underside of the exhaust guide plate by threaded fasteners.

4. An outboard motor as set forth in claim 3, wherein threaded fasteners that affix the drive shaft housing and lower unit to the underside of the exhaust guide plate are accessible without removing the cover.

5. An outboard motor as set forth in claim 1, wherein the tray is affixed to the upper side of the exhaust guide plate.

6. An outboard motor as set forth in claim 5, wherein the cover is directly secured to the underside of the exhaust guide plate by threaded fasteners.

7. An outboard motor as set forth in claim 6, wherein the drive shaft housing and lower unit is also affixed to the underside of the exhaust guide plate by threaded fasteners.

8. An outboard motor as set forth in claim 7, wherein threaded fasteners that affix the drive shaft housing and lower unit to the underside of the exhaust guide plate are accessible without removing the cover.

9. An outboard motor as set forth in claim 7, wherein said cover is detachably connected to said exhaust guide plate.

* * * * *